US008434727B2

(12) United States Patent
Sakamoto et al.

(10) Patent No.: US 8,434,727 B2
(45) Date of Patent: May 7, 2013

(54) FIXING BRACKET, FIXING METHOD OF FIXING BRACKET AND FIXING STRUCTURE OF FIXING BRACKET

(75) Inventors: Nobuyuki Sakamoto, Makinohara (JP); Keiko Ishida, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/164,157

(22) Filed: Jun. 20, 2011

(65) Prior Publication Data

US 2011/0248135 A1 Oct. 13, 2011

Related U.S. Application Data

(62) Division of application No. 12/153,007, filed on May 12, 2008, now abandoned.

(30) Foreign Application Priority Data

May 24, 2007 (JP) ..... P2007-137933
May 24, 2007 (JP) ..... P2007-138137

(51) Int. Cl.
*A47F 5/00* (2006.01)

(52) U.S. Cl.
USPC ..... 248/309.1; 248/201; 248/300

(58) Field of Classification Search ..... 439/553, 439/556, 876, 877; 411/520; 248/300, 316.8, 248/309.1, 675, 680, 27.1, 27.3, 201, 220.22, 248/500, 510
See application file for complete search history.

(56) References Cited

U.S. PATENT DOCUMENTS

| | | | | |
|---|---|---|---|---|
| 2,707,013 | A * | 4/1955 | Flora et al. | 411/173 |
| 3,588,792 | A * | 6/1971 | Kindell | 439/801 |
| 4,181,385 | A | 1/1980 | DeSantis et al. | 439/83 |
| 4,911,659 | A | 3/1990 | Viselli | 439/570 |
| 5,120,256 | A | 6/1992 | Walden | 439/553 |
| 5,395,265 | A | 3/1995 | DiMondi et al. | 439/553 |
| 5,533,908 | A | 7/1996 | Henry et al. | 439/329 |
| 5,697,799 | A | 12/1997 | Consoli et al. | 439/181 |
| 5,704,807 | A | 1/1998 | Sherman et al. | 439/570 |
| 5,971,809 | A | 10/1999 | Ho | 439/660 |
| D421,562 | S * | 3/2000 | Persson | D8/341 |
| 6,645,005 | B2 | 11/2003 | Wu | 439/563 |
| 6,971,899 | B1 | 12/2005 | Liu | 439/326 |
| 7,001,212 | B1 | 2/2006 | Juntwait | 439/566 |
| 7,048,576 | B2 | 5/2006 | Nakano | 439/570 |
| 7,074,079 | B2 | 7/2006 | Higuchi | 439/566 |
| 7,121,880 | B2 | 10/2006 | Sasaki et al. | 439/566 |
| 7,347,725 | B2 | 3/2008 | Sakamoto | 439/566 |
| 7,540,770 | B2 | 6/2009 | Ishizuka et al. | 439/570 |
| 7,789,606 | B2 * | 9/2010 | Kosidlo et al. | 411/173 |
| 2002/0111064 | A1 | 8/2002 | Kohno | 439/547 |
| 2002/0168893 | A1 | 11/2002 | Kasahara | 439/573 |
| 2007/0066117 | A1 | 3/2007 | Sakamoto | 439/326 |

FOREIGN PATENT DOCUMENTS

| | | |
|---|---|---|
| JP | A-09-326269 | 12/1997 |
| JP | A-2000-223192 | 8/2000 |
| JP | A-2002-246085 | 8/2002 |
| JP | A-2004-235106 | 8/2004 |
| JP | 2006-031944 | 2/2006 |

* cited by examiner

*Primary Examiner* — Korie H Chan
(74) *Attorney, Agent, or Firm* — Morgan, Lewis & Bockius LLP

(57) ABSTRACT

A fixing bracket for fixing a housing on a board includes: a placing portion configured to be placed on the board; an attaching portion configured to be attached to the housing; and a retaining portion which retains the placing portion to the board. The placing portion may include a receiving portion which accommodates the retaining portion.

11 Claims, 20 Drawing Sheets

FIXING BRACKET, FIXING METHOD OF FIXING BRACKET AND FIXING STRUCTURE OF FIXING BRACKET

This application is a divisional of prior application Ser. No. 12/153,007, filed May 12, 2008 now abandoned, which claims priority to Japanese Patent Applications P2007-137933, filed May 24, 2007 and P2007-138137, filed May 24, 2007.

BACKGROUND

The present invention relates to a fixing bracket for fixing a connector to a board, a fixing method of fixing the fixing bracket and a fixing structure of fixing the fixing bracket.

A surface mounting type connector attached to a board by using this type fixing bracket is conventionally disclosed in Patent Document 1 described below. On both side walls of the connector body composing this connector, terminal holders used for fixation are arranged. Each terminal holder used for fixation includes a pair of engaging pieces provided on the side walls. A terminal for fixation, which is attached to the terminal holder for fixation, includes: an engaging portion engaged with an engaging piece; and a soldering portion which is placed on a board and soldered. The soldering portion is composed integrally with the engaging portion being substantially perpendicularly bent with respect to the engaging portion. The engaging portion of the terminal for fixation is engaged with an engaging piece of the terminal holder for fixation from the upper side.

When the engaging portion of the terminal for fixation is engaged and temporarily fixed to an engaging piece of the terminal holder for fixation and a soldering portion is placed and soldered onto the board, the connector body is attached onto the board. Since the engaging portion is engaged with the engaging piece from the upper side and the soldering portion is soldered onto the board, the connector body is prevented from being disconnected upward from the board.

[Patent Document 1] JP-A-2006-31944

In the case of the above conventional surface mounting type connector, the soldering portion having a flat placing face is placed on the flat board and soldered and fixed so as to attach the connector body onto the board. Therefore, the connector body is easily disconnected from the board. Especially when a force, which separates the soldering portion from the board, is given perpendicularly to the primary face of the board, the connector body is easily disconnected from the board together with the soldering portion.

SUMMARY

The present invention has been accomplished in view of the above points. An object of the present invention is to provide a fixing bracket capable of preventing a connector from being disconnected from a board, a fixing method of fixing the fixing bracket and a fixing structure of fixing the fixing bracket.

In order to accomplish the above object, the present invention provides a fixing bracket for fixing a housing on a board, including:

a placing portion configured to be placed on the board;

an attaching portion configured to be attached to the housing; and a retaining portion which retains the placing portion to the board.

Preferably, the placing portion includes a receiving portion which accommodates the retaining portion.

Here, it is preferable that the receiving portion is integrally formed with the placing portion.

Preferably, the retaining portion protrudes from the placing portion toward the board.

Preferably, the placing portion includes a hole for inserting the retaining portion.

Preferably, the retaining portion is integrally formed with the placing portion.

In order to accomplish the above object, the present invention also provides a method of fixing a housing to a board, including:

providing a fixing bracket which includes: a placing portion configured to be placed on a board; an attaching portion substantially perpendicular to the placing portion; and a retaining portion;

inserting the retaining portion into a through hole of the board so as to retain the placing portion on the board; and fixing the retaining portion to the board using a fixing member.

Preferably, the placing portion has an elongated plate portion, the method further including folding the plate portion so as to be inserted into a hole of the placing portion to form the retaining portion.

In order to accomplish the above object, the present invention also provides a fixing structure of a fixing bracket, including:

a board;

a housing; and a fixing bracket including:

a placing portion placed on the board;

an attaching portion attached to the housing; and a retaining portion which retains the placing portion to the board, wherein the retaining portion is fixed to the board using a fixing member.

According to the present invention, it is possible to prevent a connector from being disconnected from a board.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION

Figure 1:
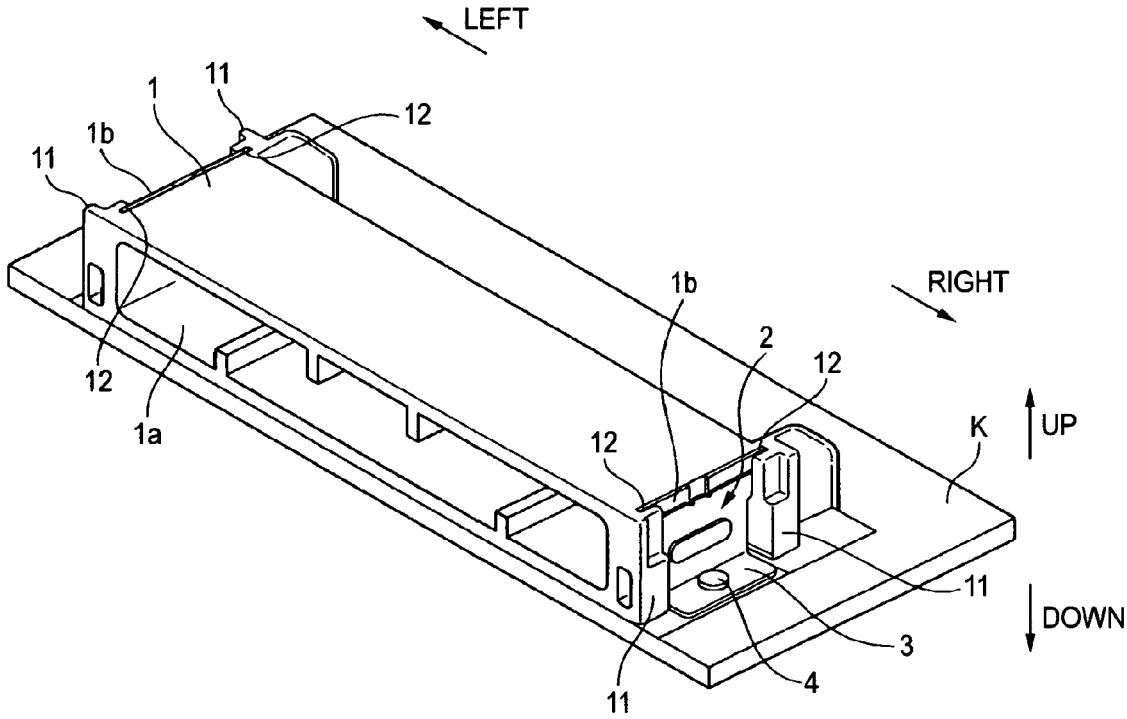
FIG. 1 is a perspective view showing a connector housing attached to a board by using an attaching member of a first embodiment.

Referring to the drawings, a first embodiment of the present invention will be explained below.

Figure 2:
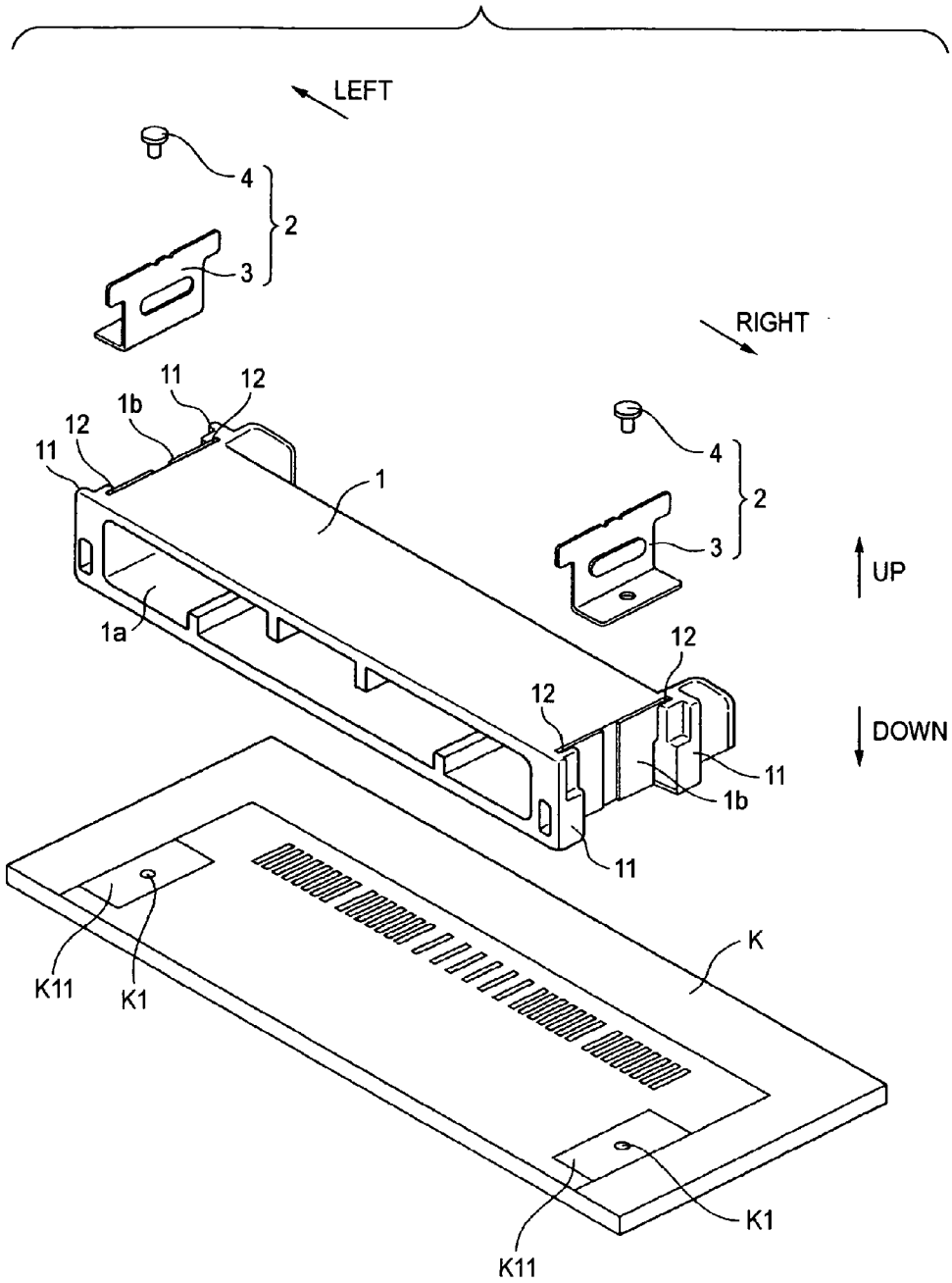
FIG. 2 is an exploded perspective view for explaining an attaching structure of the housing shown in FIG. 1.

FIG. 1 is a perspective view showing a connector housing 1 attached to board K by using a fixing bracket 2 of this embodiment. FIG. 2 is an exploded perspective view for explaining an attaching structure of the housing 1 shown in FIG. 1. In this connection, directions of "before and behind", "right and left" and "up and down" described in the following explanations are shown in the drawings. The phrases of "before and behind", "right and left" and "up and down" are described for explanations. Therefore, of course, they may be different from the actual arrangement.

The connector having the housing 1 shown in FIGS. 1 and 2 is a surface mounting type connector for connecting a terminal of a board K, which is mounted on the housing 1, with a terminal of a board (not shown) inserted from an opening portion 1*a* of the housing 1. The housing 1 is made of synthetic resin material having the insulating property and formed into a box-shape. The housing 1 is attached to the board K through the fixing bracket 2. On the right and left outer walls 1*b* of the housing 1, a pair of supporting portions 11, which have protruding portions on both sides of the outer wall face 1*b*, are provided.

Each supporting portion 11 is formed into a substantially square block-shape extending in the longitudinal direction from an upper end to a lower end of the outer wall face 1*b*. In a base end portion protruding from the outer wall face 1*b*, an engaging groove 12 is provided. The engaging groove 12 is arranged on each of the inside faces of both supporting portions 11, which are opposed to each other, and formed out of a groove of a predetermined width which extends downward by a predetermined distance from an upper end of the supporting portion 11. An upper end of the engaging groove 12 is open to an upper face of the supporting portion 11.

Figure 3:
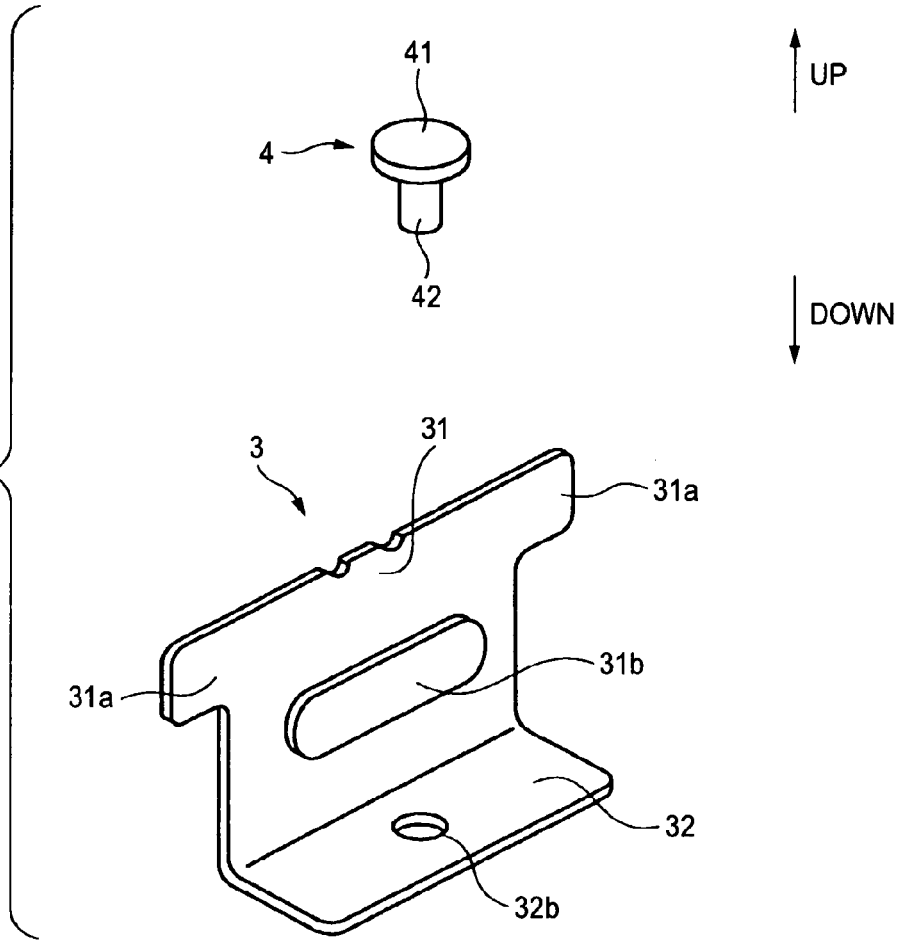
FIG. 3 is an exploded perspective view in which the fixing bracket of the first embodiment is shown being enlarged.

FIG. 3 is an exploded perspective view in which the fixing bracket 2 is shown being enlarged. The fixing bracket 2 is made of metal such as copper or stainless steel. The fixing bracket 2 includes: an attaching piece 3 which is engaged with a supporting portion 11 of the housing 1 and attached onto the board K; and an engaging peg 4 which is engaged with the attaching piece 3 and fixes the attaching piece 3 to the board K.

The attaching piece 3 has a shape in which a lower portion of a plate-shaped body, which is a substantially rectangular flat plate, is substantially perpendicularly bent. Further, an extended width portion is provided at an upper end portion of the attaching piece 3. The attaching piece 3 includes: an engaging portion 31 composed of an upper side of the bent portion; and a placing portion 32 composed of a lower side of the bent portion.

The engaging portion 31 is an attaching portion for attaching the fixing bracket 2 to the supporting portion 11 of the housing 1. Protruding portions, which protrude to both sides of the extended width portion of the engaging portion 31, are engaging pieces 31*a* to be engaged with the engaging grooves 12 of the supporting portion 11 from the upper side. The engaging piece 31*a* is somewhat thinner than the width of the engaging groove 12 of each supporting portion 11. The engaging piece 31*a* is extended downward from the upper end of the engaging portion 31 by a length a little shorter than the length of the engaging groove 12.

In a central portion of the engaging portion 31 in the height direction, an embossed portion 31*b* is provided. The embossed portion 31*b* is provided for preventing the fixing bracket 2 from being deformed. When the engaging portion 31 is viewed from the front, the embossed portion 31*b* shows an elliptic shape.

The placing portion 32 is placed on one primary face of the board K so that the placing portion 32 can be fixed to the board K. In a central portion of the placing portion 32, an inserting hole 32*a* is provided. Into the insertion hole 32*a*, a leg portion 42, which will be described later, of the engaging peg 4 is inserted. An inner diameter of the insertion hole 32*a* is somewhat larger than an outer diameter of the leg portion 42 of the engaging peg 4. The insertion hole 32*a* penetrates between both primary faces of the placing portion 32.

The engaging peg 4 has a rod-shaped body, one end of which is extended so that a head portion 41 can be formed. The leg portion 42 of the engaging peg 4 is inserted into the insertion hole 32*a* of the placing portion 32 from the upper side and soldered to the placing portion 32 in the periphery of the insertion hole 32*a*.

As shown in FIG. 2, on the board K on which the housing 1 is mounted, fixing holes K1, into which the leg portions 42 of the engaging pegs 4 are inserted, are provided. An inner diameter of the fixing hole K1 is somewhat larger than an outer diameter of the leg portion 42 of the engaging peg 4 and the fixing hole K1 penetrates between both primary faces of the board K. On the primary face of the board K in the periphery of the fixing hole K1, attaching portion K1 covered with copper foil is provided. An inner circumferential face of fixing hole K1 is also covered with copper foil.

Figure 4A:
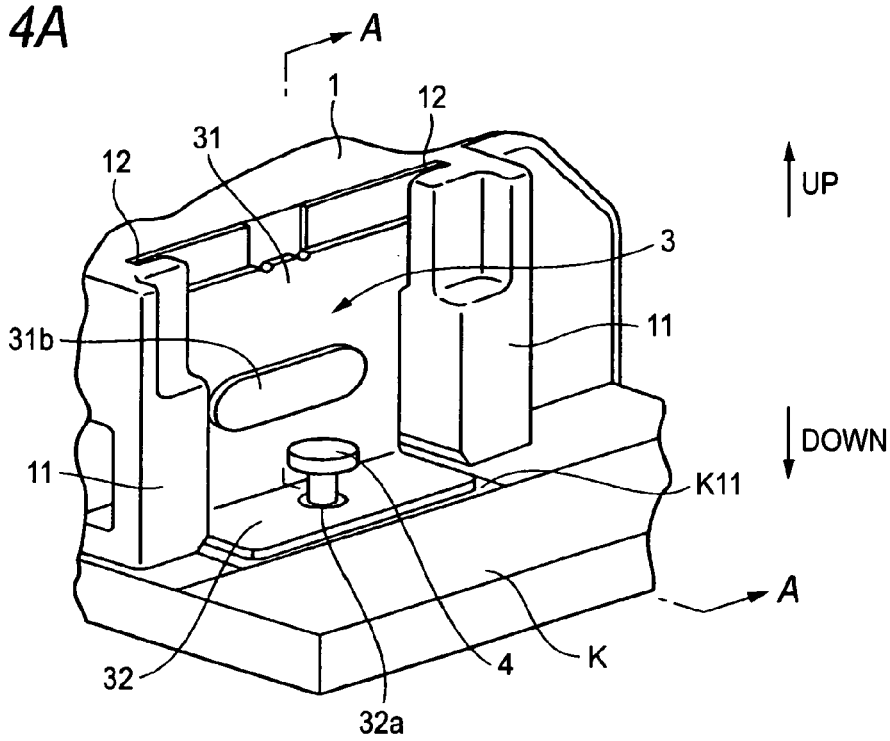
FIG. 4A is a perspective view of a housing which is placed on the board when an attaching piece is temporarily fixed to a supporting portion.
Figure 4B:
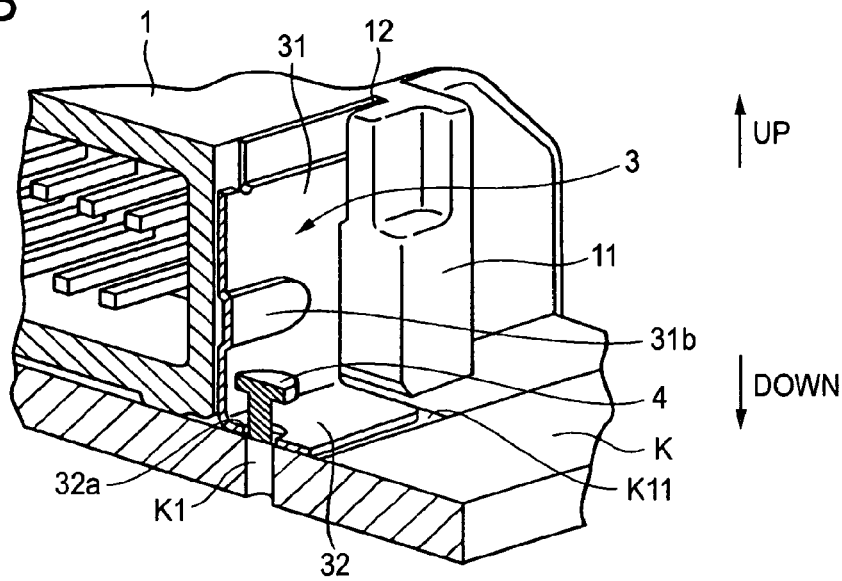
FIG. 4B is a cross-sectional view taken on line A-A in FIG. 4A.
Figure 5:
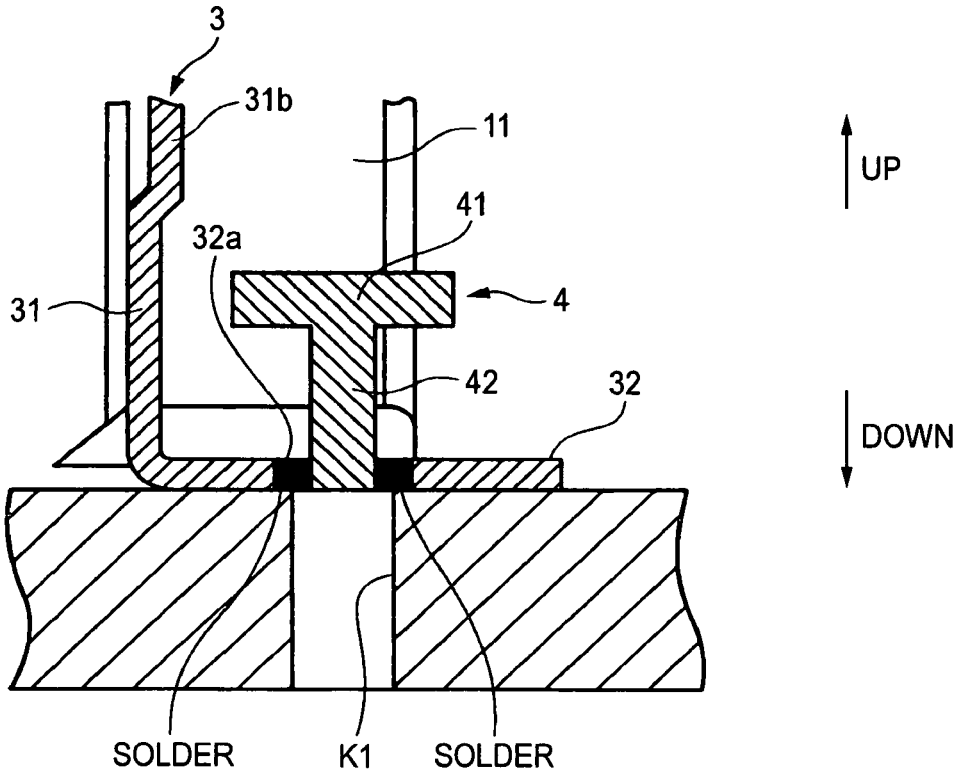
FIG. 5 is a first view for explaining a positional relation between a leg portion of an engaging member and a fixing hole of the board.
Figure 6A:
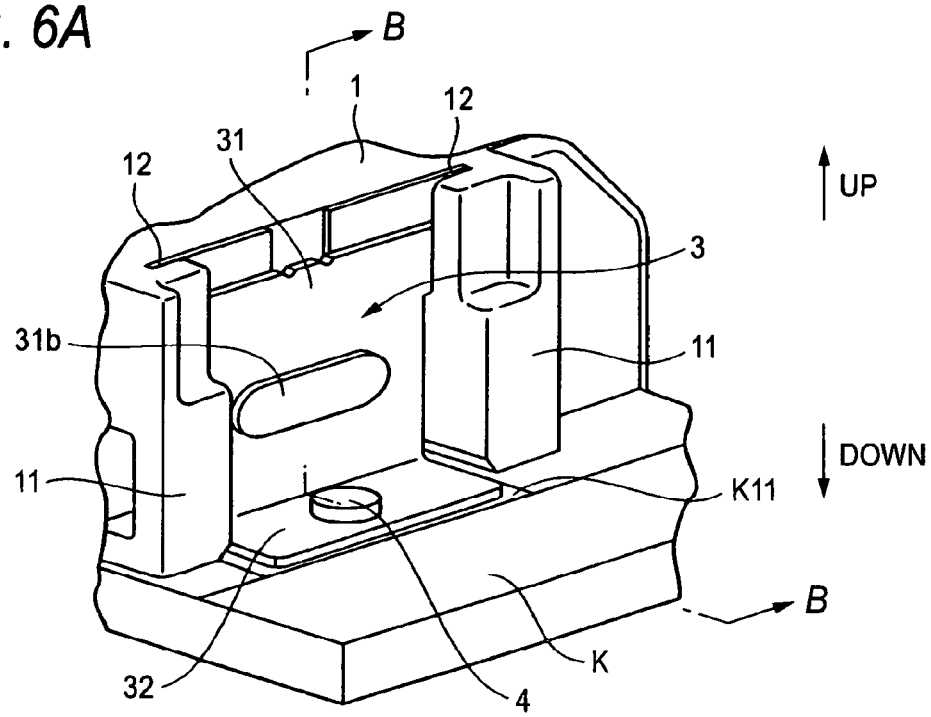
FIG. 6A is a perspective view of the housing attached to the board.
Figure 6B:
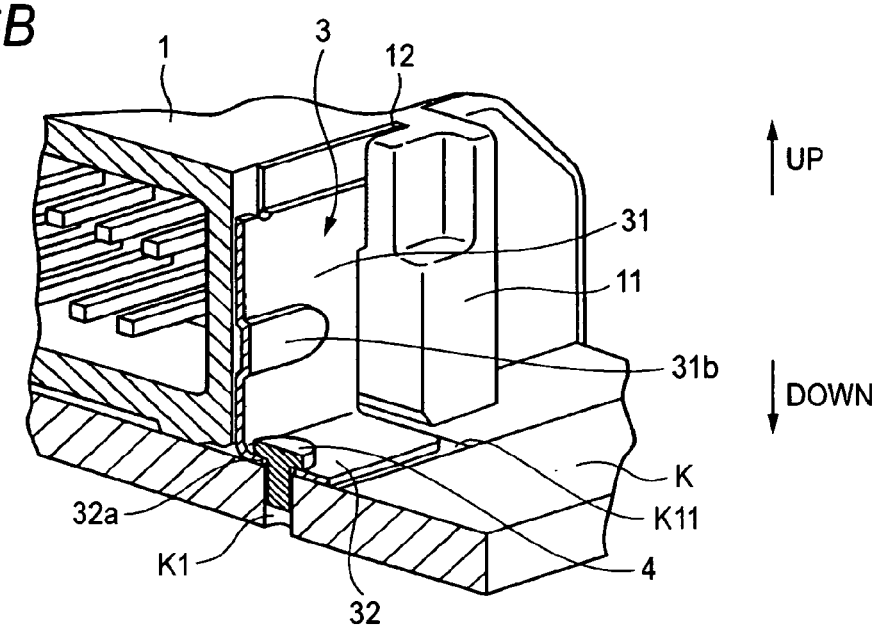
FIG. 6B is a cross-sectional view taken on line B-B in FIG. 6A.
Figure 7:
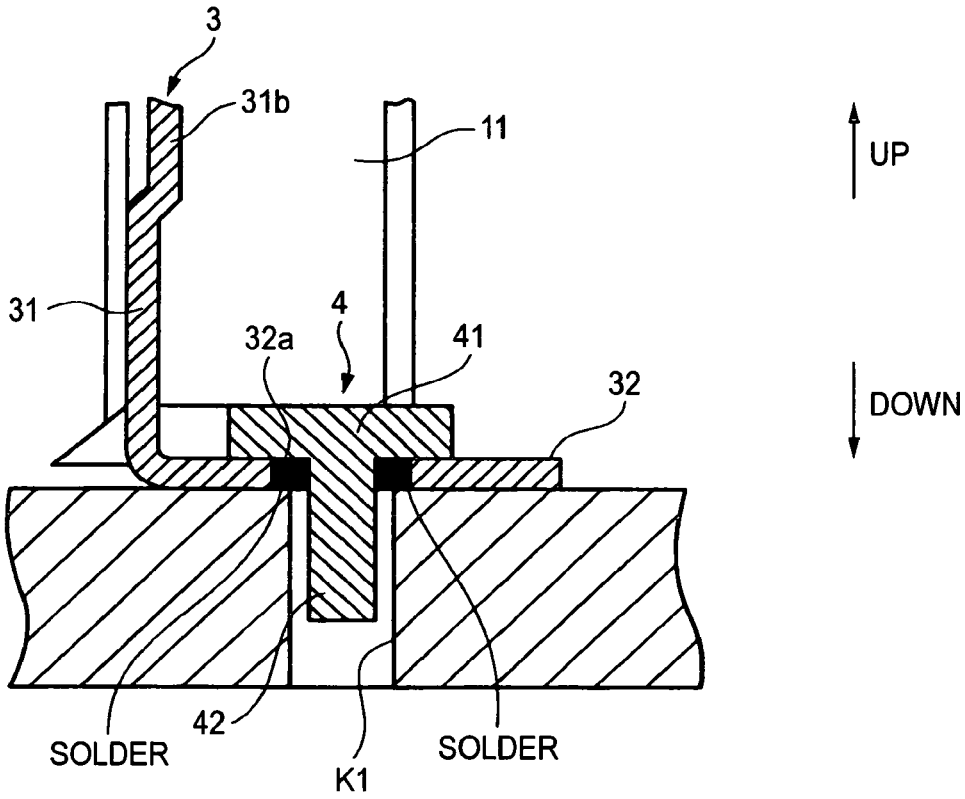
FIG. 7 is a second view for explaining a positional relation between the leg portion of the engaging member and the fixing hole of the board.

Next, explanations will be made into a working process in which the connector housing 1 is attached to the board K by using the fixing bracket 2 composed as described above. FIG. 4A is a perspective view of the housing 1 which is placed on the board K when the attaching piece 3 is engaged with the supporting portion 11. FIG. 4B is a cross-sectional view taken on line A-A in FIG. 4A. FIG. 5 is a first view for explaining a positional relation between the leg portion 42 of the engaging peg 4 and the fixing hole K1 of the board K. FIG. 6A is a perspective view of the housing 1 attached to the board K. FIG. 6B is a cross-sectional view taken on line B-B in FIG. 6B. FIG. 7 is a second view for explaining a positional relation between the leg portion 42 of the engaging peg 4 and the fixing hole K1 of the board K.

First of all, the attaching piece 3 of the fixing bracket 2 is inserted into the supporting portion 11 of the housing 1 from the upper side and engaged and temporarily fixed. Specifically, the attaching piece 3 is advanced into between both supporting portions 11 of the outer wall faces 1*b* of the housing 1 from the lower end side on which the placing portion 32 is provided.

A lower end of the engaging piece 31*a*, which is moved to a position close to the upper face of the housing 1, is inserted into an upper end opening portion of the engaging groove 12 of the supporting portion 11. When the attaching piece 3 continues to proceed between both supporting portions 11, a lower end portion of the engaging piece 31*a* of the engaging portion 31 comes into contact with a lower end portion of the engaging groove 12. Due to the foregoing, the attaching piece 3 is restricted from moving downward. At the same time, the attaching piece 3 is positioned with respect to the housing 1.

In this way, the attaching piece 3 of the fixing bracket 2 is engaged and temporarily fixed onto the right and left outer walls 1*b* of the housing 1. Successively, as shown in FIG. 4, the housing 1, to which the attaching piece 3 is temporarily attached, is placed on the attaching portion K11 of the board K together with the placing portion 32 of the attaching piece 3. At this time, as shown in FIG. 5, positioning is executed so that the leg portion 42 of the engaging peg 4, which is engaged with the placing portion 32 of the attaching piece 3, can be placed at a position above the fixing hole K1 of the board K.

After it is confirmed that the leg portion 42 of each engaging peg 4 is positioned above the fixing hole K1 of the board K, the periphery of the placing portion 32, which is placed on the attaching portion K11 of the board K, is soldered to the attaching portion K11. Further, solder, which connects the engaging peg 4 with the insertion hole 32*a* of the placing portion 32, is melted. By using the thus melted solder, the engaging peg 4 is soldered to the fixing hole K1 of the board K.

When the solder used for soldering is cooled and solidified, the placing portion 32 and the engaging peg 4 are fixed onto the board K as shown in FIGS. 6A and 6B. The solder for fixing the engaging peg 4 onto the board K composes a fixing means. As shown in FIG. 7, a lower face of the head portion 41 of the engaging peg 4, which has been fixed onto the board K, is engaged with an upper face in the periphery of the insertion hole 32*a* of the placing portion 32. Therefore, the placing portion 32 is restricted from moving upward. Next, a second embodiment of the present invention will be explained below.

Figure 8:
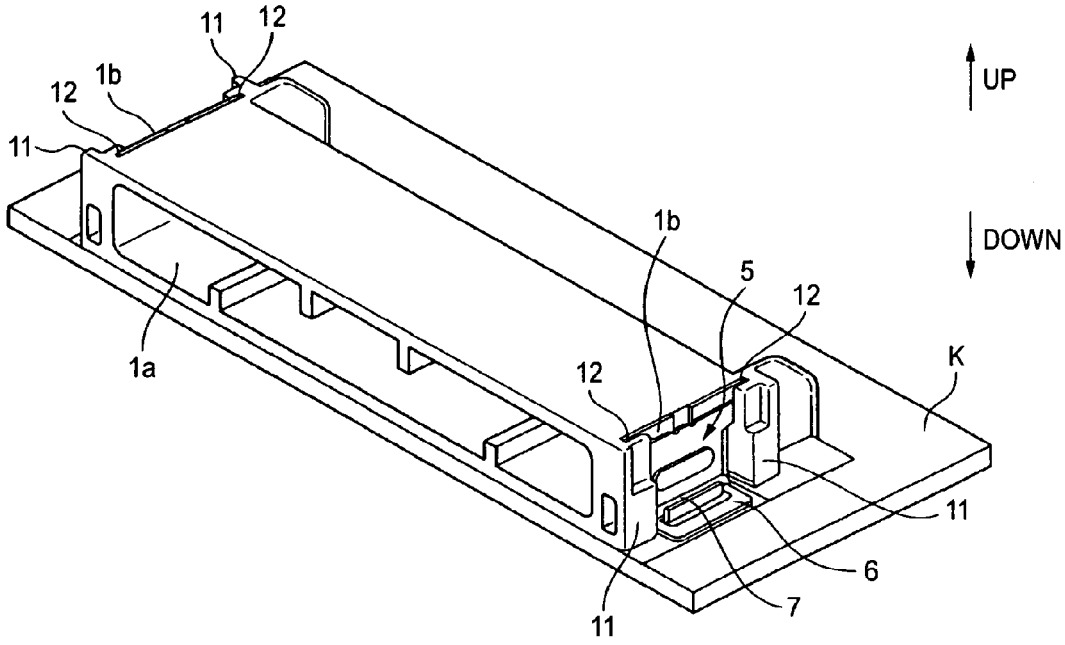
FIG. 8 is a perspective view showing a connector housing attached to a board by using a fixing bracket of a second embodiment.
Figure 9:
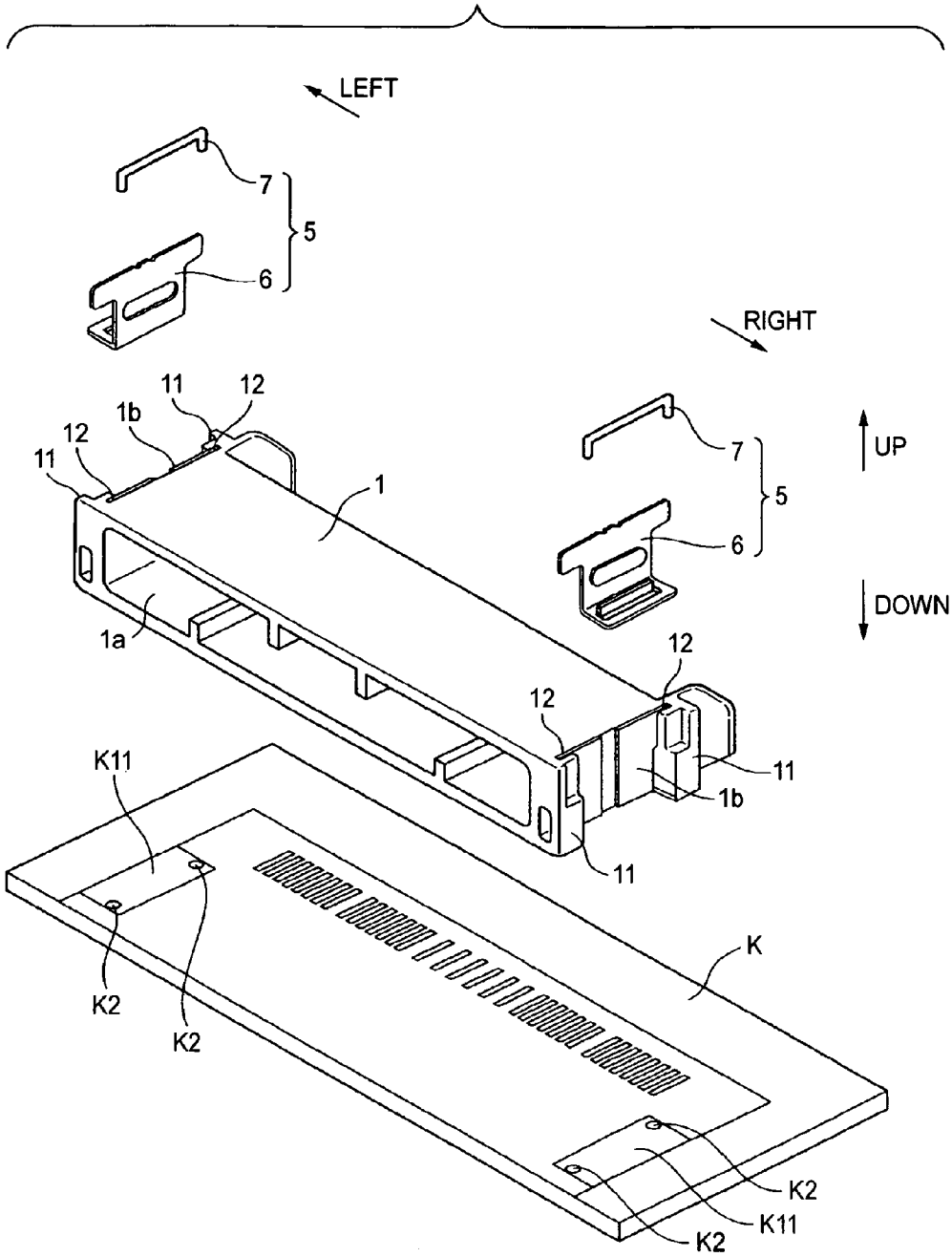
FIG. 9 is an exploded perspective view for explaining an attaching structure of the housing shown in FIG. 8.

FIG. 8 is a perspective view showing a connector housing 1 attached to a board K by using a fixing bracket 5 of this embodiment. FIG. 9 is an exploded perspective view for explaining an attaching structure of the housing 1 shown in FIG. 8.

The connector having the housing 1 shown in FIGS. 8 and 9 is a surface mounting type connector composed in the same manner as that of the first embodiment described before. The right and left outer walls 1*b* of the housing 1, to which the fixing brackets 5 are attached, are also composed in the same manner.

Figure 10:
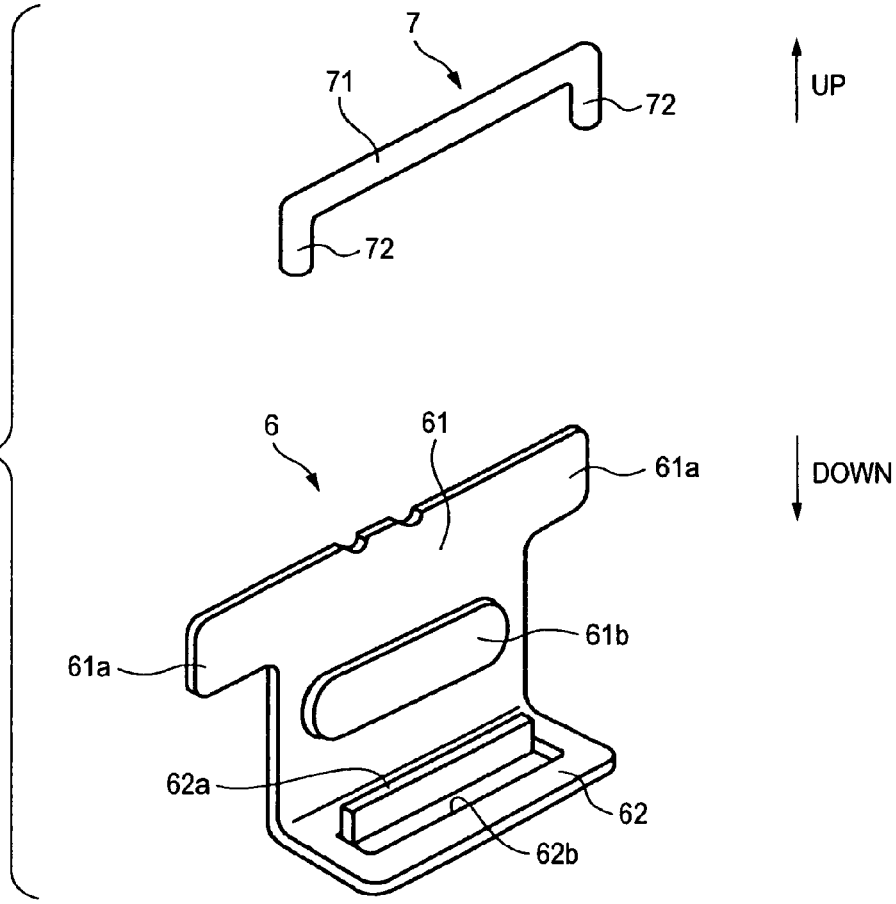
FIG. 10 is an exploded perspective view in which the fixing bracket of the second embodiment is shown being enlarged.

FIG. 10 is an exploded perspective view in which the fixing bracket 5 is shown being enlarged. In the same manner as that of the attaching member 2 of the first embodiment, the fixing bracket 5 has an attaching piece 6 and an engaging peg 7. The attaching piece 6 has an engaging portion 61 and a placing portion 62. The engaging portion 61 is composed in the same manner as that of the engaging portion 31. However, the placing portion 62 of the fixing bracket 5 and the engaging peg 7 are composed differently from the placing portion 32 and the engaging peg 4 of the first embodiment described before.

In the central portion of the placing portion 62, an accommodating portion 62*a*, which will be referred to as a tongue piece hereinafter, extending in the width direction is provided. The tongue piece 62*a* is a substantially rectangular tongue piece formed in such a manner that a C-shaped rectangular piece is bent in the extending direction of the engaging portion 61 and arranged in the placing portion 62 so that an opening end of the C-shaped rectangular piece can be directed to the engaging portion 61 side. The tongue piece 62*a* is capable of accommodating the engaging peg 7 which is an engaging member.

The engaging peg 7 is formed in such a manner that both end portions of a rod-shaped body are substantially perpendicularly bent in the same direction. End portions of the bent portions of the engaging peg 7 are leg portions 72. A central portion 71 of the engaging peg 7 located between both leg portions 72 is somewhat longer than the width of the placing portion 62. The central portion 71 of the engaging peg 7 is located at a position above the tongue piece 62*a* and the bent portions of both end portions are protruded downward from the outside on both sides in the width direction of the placing portion 62. Then the engaging peg 7 is soldered to the side of the placing portion 62.

As shown in FIG. 9, on the board K on which the housing 1 is mounted, fixing holes K2, into which a pair of leg portions 72 of the engaging peg 7 are inserted and fixed, are formed. An inner diameter of each fixing hole K2 is somewhat larger than an outer diameter of the leg portion 72 of the engaging peg 7. The fixing hole K2 penetrates both primary faces of the board K. On the inner circumferential face of the fixing hole K2, a piece of copper foil is stuck.

Figure 11A:
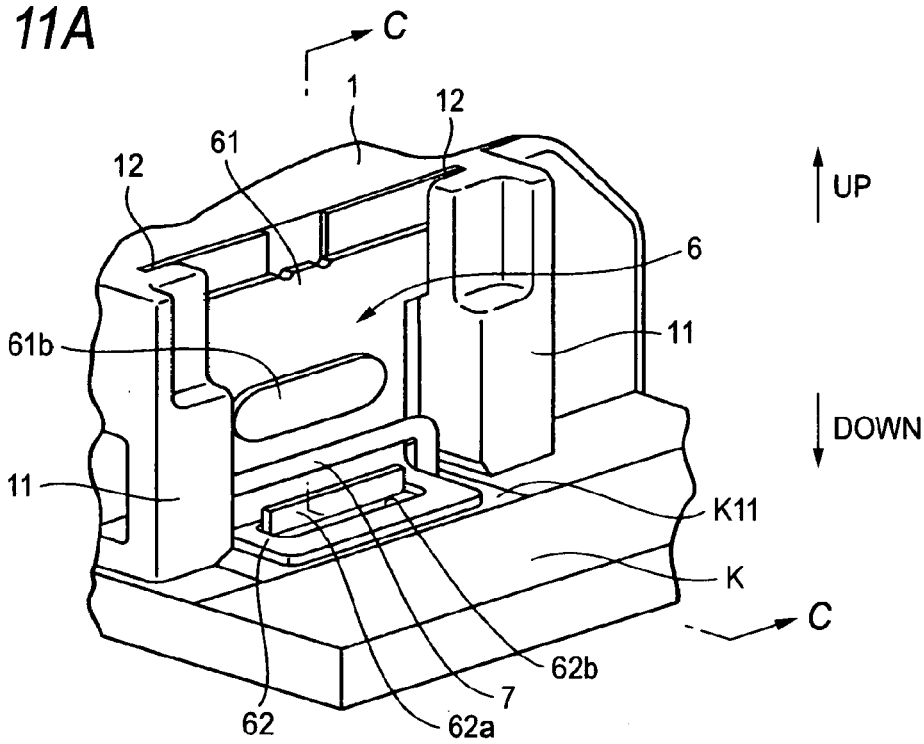
FIG. 11A is a perspective view of the housing which is placed on a board in such a manner that an attaching piece is temporarily fixed to a supporting portion.
Figure 11B:
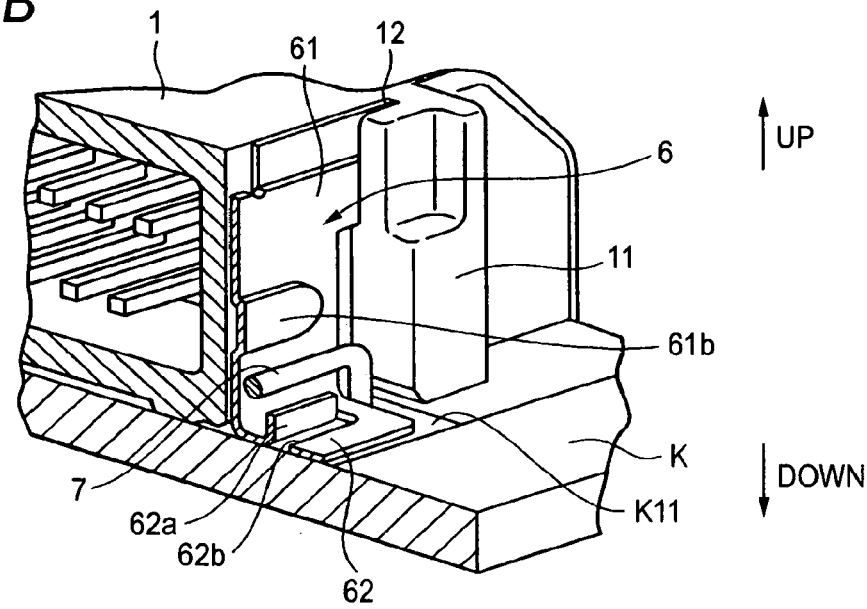
FIG. 11B is a cross-sectional view taken on line C-C in FIG. 11A.
Figure 12:
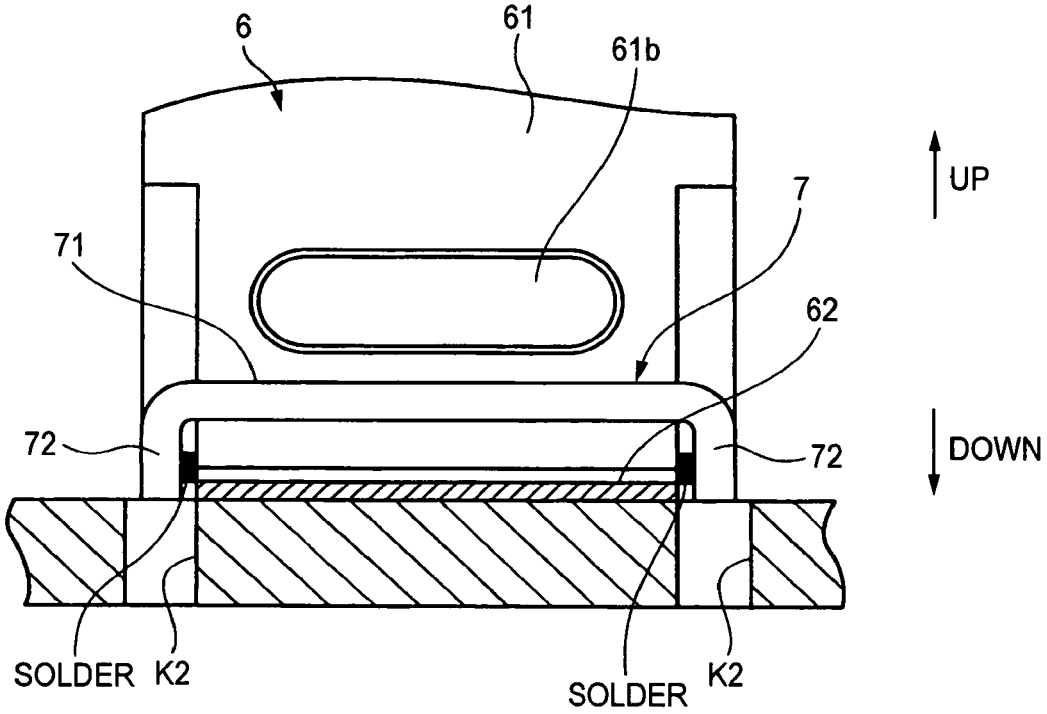
FIG. 12 is a first view for explaining a positional relation between a leg portion of an engaging member and a fixing hole of a board.
Figure 13A:
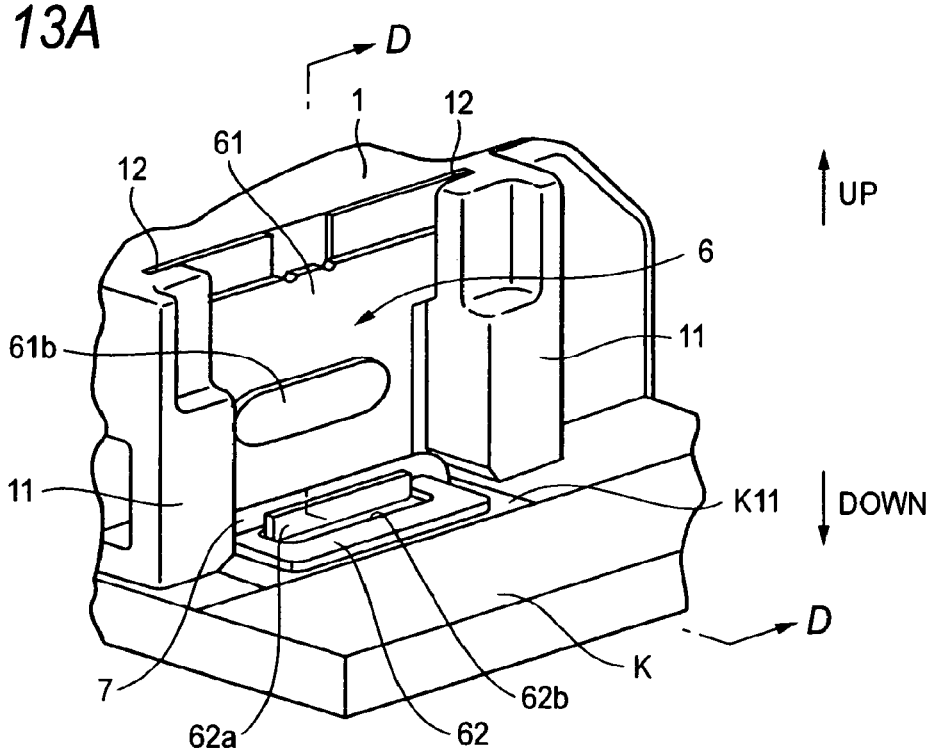
FIG. 13A is a perspective view of the housing attached onto the board.
Figure 13B:
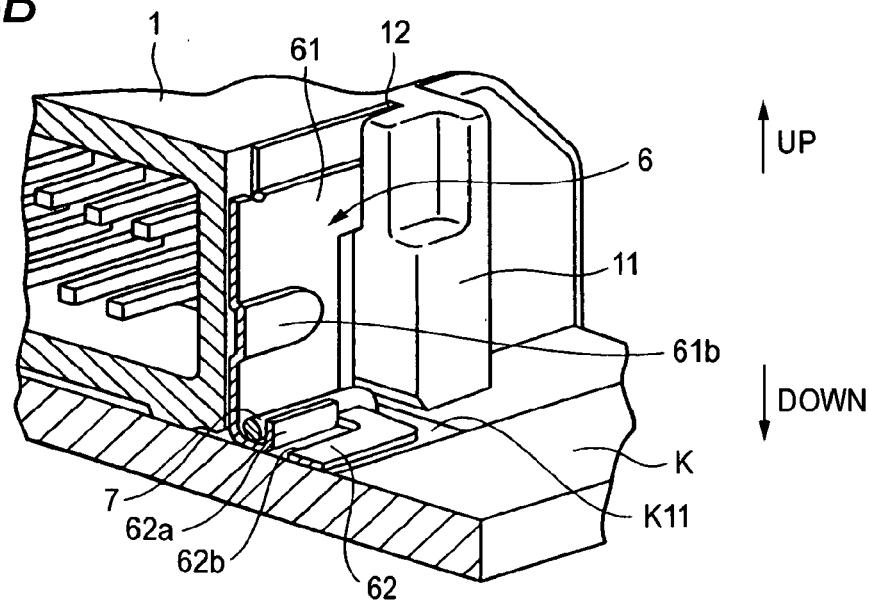
FIG. 13B is a cross-sectional view taken on line D-D in FIG. 13A.
Figure 14:
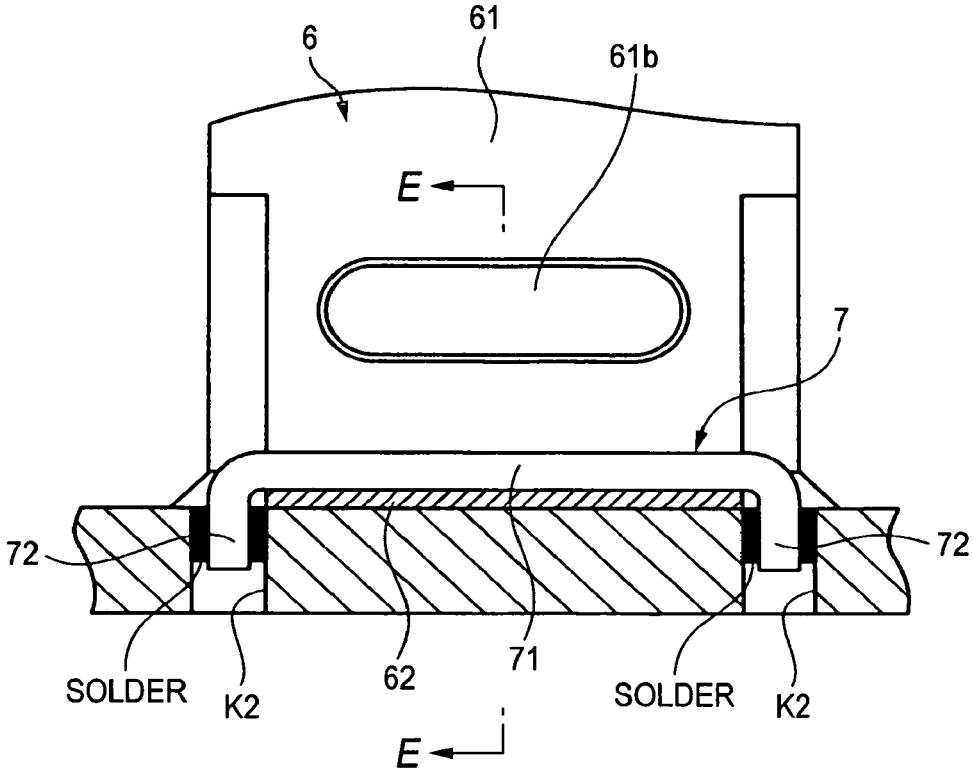
FIG. 14 is a second view for explaining a positional relation between the leg portion of the engaging member and the fixing hole of the board.

FIG. 11A is a perspective view of the housing 1 which is placed on the board K in such a manner that the attaching piece 6 is engaged with the supporting portion 11. FIG. 11B is a cross-sectional view taken on line C-C in FIG. 11A. FIG. 12 is a first view for explaining a positional relation between the leg portion 72 of the engaging peg 7 and the fixing hole K2 of the board K. FIG. 13A is a perspective view of the housing 1 attached onto the board K. FIG. 13B is a cross-sectional view taken on line D-D in FIG. 13A. FIG. 14 is a second view for explaining a positional relation between the leg portion 72 of the engaging peg 7 and the fixing hole K2 of the board K.

When the connector housing 1 is attached onto the board K by using the fixing bracket 5 composed as described above, in the same manner as that of the first embodiment described before, the attaching piece 6 of the fixing bracket 5 is engaged and temporarily fixed to the engaging groove 12 of the supporting portion 11 of the housing 1. Then, as shown in FIGS. 11A and 11B, the housing 1, to which the attaching piece 6 is temporarily fixed, is placed on the primary face of the board K together with the placing portion 62 of the attaching piece 6. At this time, as shown in FIG. 12, positioning is executed so that the leg portion 72 of the engaging peg 7, which is engaged with the placing portion 62 of the attaching piece 6, can be placed at a position above the fixing hole K2 of the board K.

After it is confirmed that the leg portion 72 of each engaging peg 7 is positioned above the fixing hole K2 of the board K, the periphery of the placing portion 62, which is placed on the board K, is soldered to the attaching portion K11 of the board K. Further, solder, which connects the engaging peg 7 with the side of the placing portion 62, is melted. By using the thus melted solder, the engaging peg 7 is soldered to the fixing hole K2 of the board K.

Figure 15:
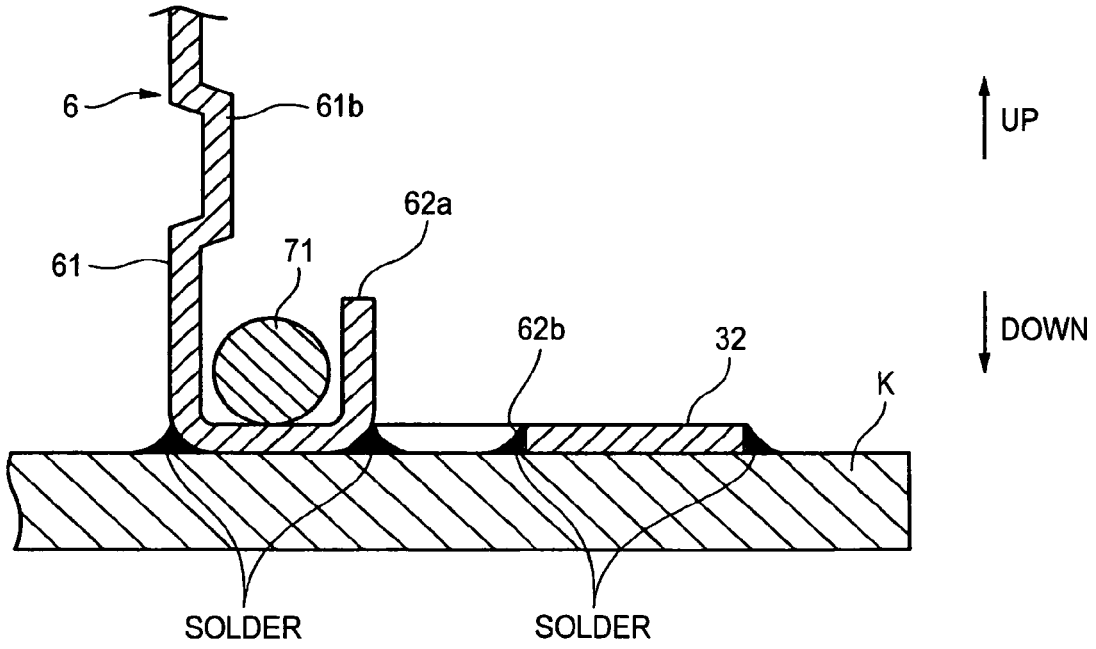
FIG. 15 is a cross-sectional view taken on line E-E in FIG. 14 for explaining a state in which the placing portion is attached onto the board.

When the solder used for soldering is cooled and solidified, the placing portion 62 and the engaging peg 7 are fixed onto the board K as shown in FIG. 13. As shown in FIG. 14, while a lower face of the central portion 71 of the engaging peg 7 is being engaged with an upper face of the tongue piece 62*a* of the placing portion 62, the engaging peg 7 is accommodated in the tongue piece 62*a*. Therefore, the placing portion 62 is restricted from moving upward. As shown in FIG. 15, the periphery of the hole portion 62*b*, which is formed in the placing portion 62 so that the tongue piece 62*a* can be provided, is also soldered and fixed onto the board K.

Referring to the drawings, a third embodiment of the present invention will be explained below.

Figure 16:
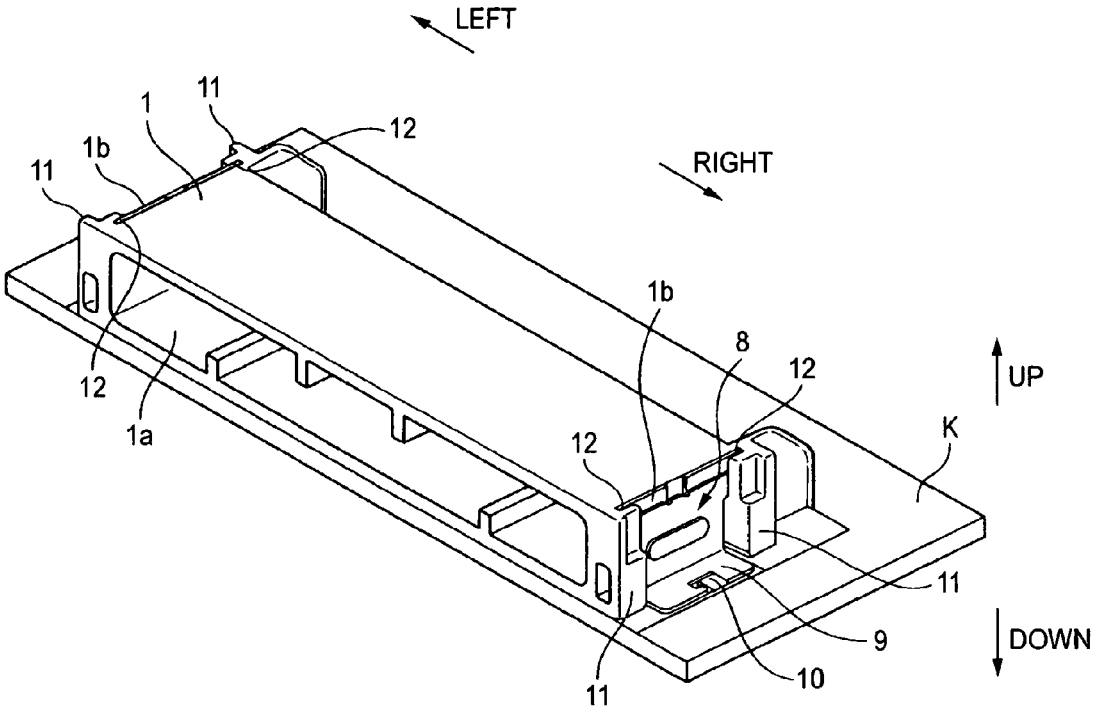
FIG. 16 is a perspective view showing a connector housing attached to a board by using a fixing bracket of a third embodiment.
Figure 17:
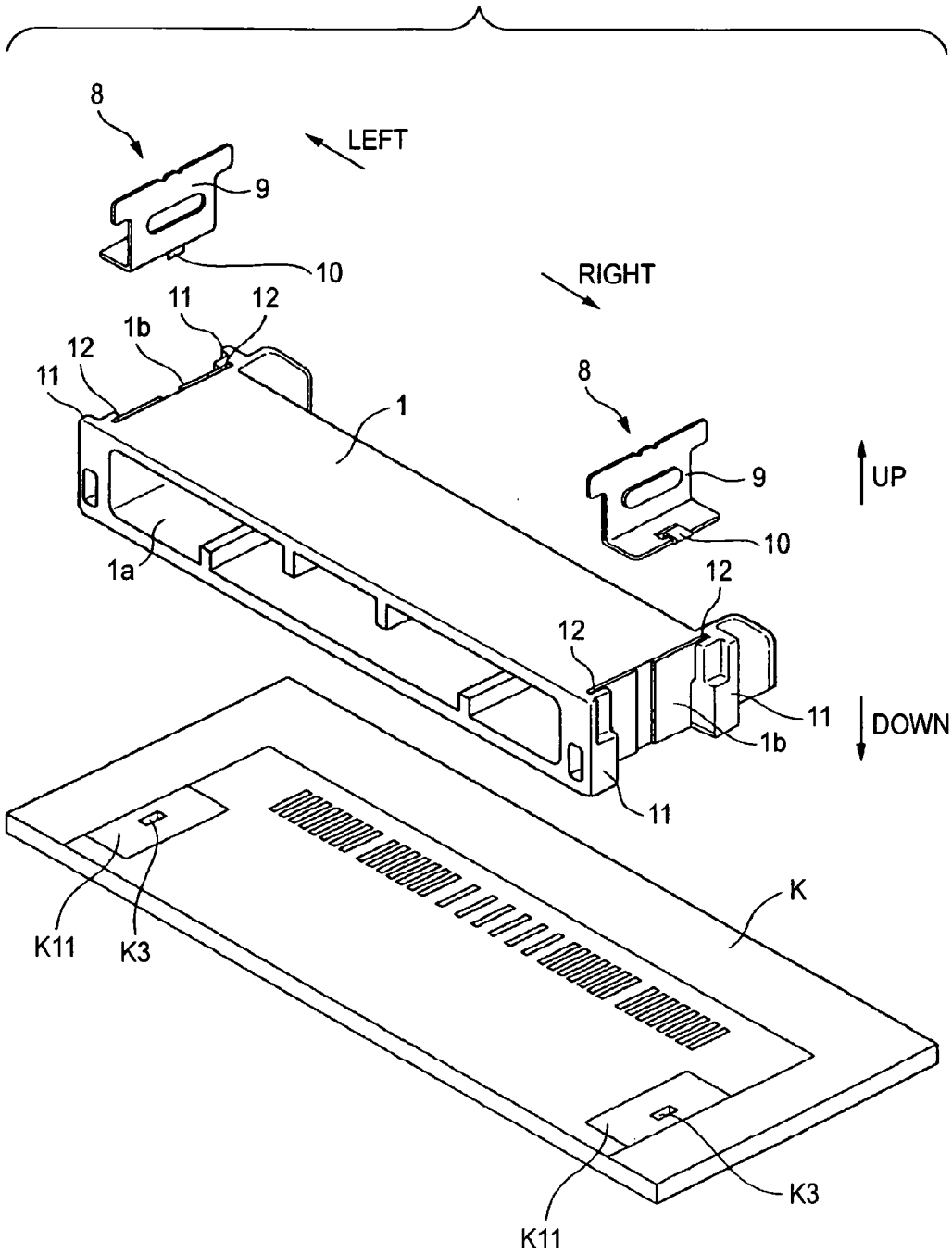
FIG. 17 is an exploded perspective view for explaining an attaching structure of the housing shown in FIG. 16.

FIG. 16 is a perspective view showing a connector housing 1 attached to a board K by using a fixing bracket 8 of this embodiment. FIG. 17 is an exploded perspective view for explaining an attaching structure of the housing 1 shown in FIG. 16.

The connector having the housing 1 shown in FIGS. 16 and 17 is a surface mounting type connector for connecting a terminal of a board K, which is mounted on the housing 1, with a terminal of a board (not shown) inserted from an opening portion 1*a* of the housing 1. The housing 1 is made of synthetic resin material having the insulating property and formed into a box-shape. The housing 1 is attached to the board K through the fixing bracket 8. On the right and left outer walls 1*b* of the housing 1, a pair of supporting portions 11, which have protruding portions on both sides of the outer wall face 1*b*, are provided.

Each supporting portion 11 is formed into a substantially square block-shape extending in the longitudinal direction from an upper end to a lower end of the outer wall face 1*b*. In a base end portion protruding from the outer wall face 1*b*, an engaging groove 12 is provided. The engaging groove 12 is arranged on each of the inside faces of both supporting portions 11, which are opposed to each other, and formed out of a groove of a predetermined width which extends downward by a predetermined distance from an upper end of the supporting portion 11. An upper end of the engaging groove 12 is open to an upper face of the supporting portion 11.

Figure 18A:
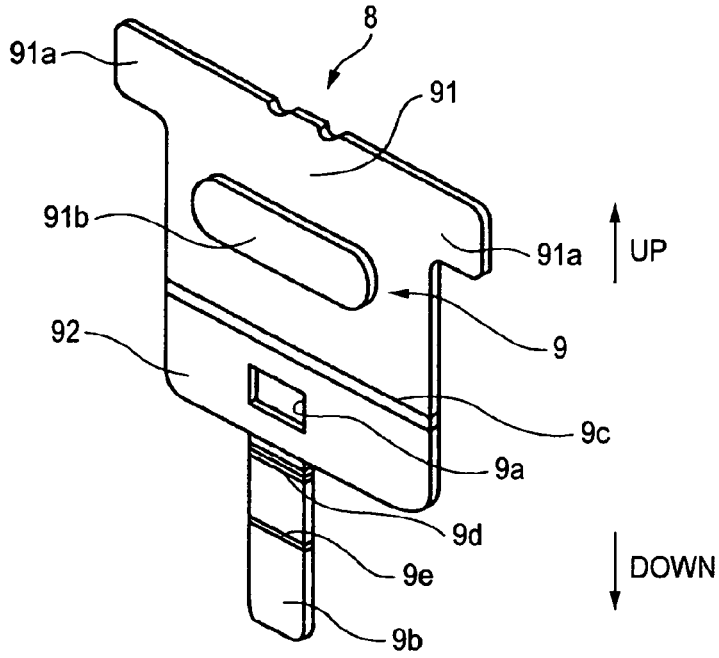
FIG. 18A is a perspective view showing a state in which the fixing bracket of the third embodiment is developed.
Figure 18B:
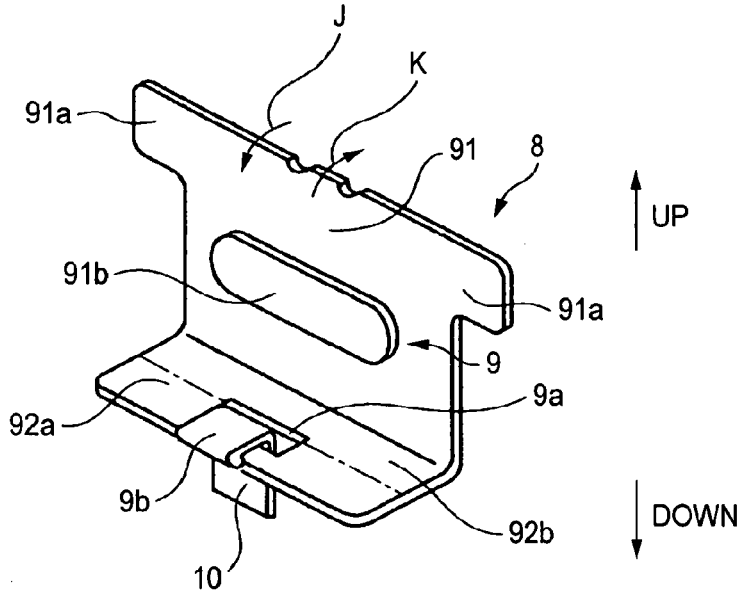
FIG. 18B is a perspective view showing a state in which the fixing bracket shown in FIG. 18A is assembled.

FIG. 18A is a perspective view showing a state in which the fixing bracket 8 is developed. FIG. 18B is a perspective view showing a state in which the fixing bracket 8 is assembled. The fixing bracket 8 is made of, for example, copper or stainless steel. The fixing bracket 8 includes: an attaching piece 9 which is engaged with the supporting portion 11 of the housing 1 and attached onto the board K; and an insertion engaging piece 10 formed out of a tongue piece 9*b* extending downward from a lower end portion of the attaching piece 9.

As shown in FIG. 18A, the fixing bracket 8 is a plate-shaped body including: an extended width portion which is provided in an upper end portion of the rectangular flat plate; and a through-hole 9*a* provided in the central portion in the width direction of the lower end portion. Further, the fixing bracket 8 includes a rectangular tongue piece 9*b* formed in the central portion in the width direction of the lower edge portion and extended downward. On the lower end portion side of the flat plate, a cut portion 9*c* used for bending is provided. In the root portion of the tongue piece 9*b*, a cut portion 9*d* for bending is provided. In the central portion in the longitudinal direction of the tongue piece 9*b*, a cut portion 9*e* for bending is provided. The cut portions 9*d*, 9*e* for bending are respectively extended in the width direction of the tongue piece 9*b*. The plate-shaped body composing the fixing bracket 8 is formed out of a flat plate by means of punching. The through-hole 9*a* and the cut portions 9*c* to 9*e* for bending are also formed at the time of punching work.

As shown in FIG. 18B, the fixing bracket 8 is formed in such a manner that the lower end side, on which the through-hole 9*a* is provided, with respect to the cut portion 9*c* for bending is substantially perpendicularly bent with respect to the upper end side having the width extended portion. The upper side with respect to the bent portion is composed as an engaging portion 91 and the lower side is composed as a placing portion 92. The tongue piece 9*b* extending downward from the lower edge portion of the placing portion 92 is substantially perpendicularly bent upward from the cut portion 9*d* for bending in the central portion in the extending direction. The tongue piece 9*b* is also substantially perpendicularly bent in the same direction from the cut portion 9*e* for bending in the base end portion. Due to the foregoing, the forward end side from the cut portion 9*e* for bending of the central portion of the tongue piece 9*b* is inserted into the through-hole 9*a* from the surface side of the placing portion 92 to the back side and protruded from the back side. In this way, the insertion engaging piece 10 is formed.

The engaging portion 91 is an attaching portion for attaching the fixing bracket 8 to the supporting portion 11 of the housing 1. Protruding portions, which protrude to both sides of the extended width portion of the engaging portion 91, are engaging pieces 91*a* to be engaged with the engaging grooves 12 of the supporting portion 11 from the upper side. The engaging piece 91*a* is somewhat thinner than the width of the engaging groove 12 of each supporting portion 11. The engaging piece 91*a* is extended downward from the upper end of the engaging portion 91 by a length a little shorter than the length of the engaging groove 12.

In a central portion of the engaging portion 91 in the height direction, an embossed portion 91*b* is provided. The embossed portion 91*b* is provided for preventing the fixing bracket 8 from being deformed. When the engaging portion 91 is viewed from the front, the embossed portion 91*b* shows an elliptic shape.

The placing portion 92 is placed on one primary face of the board K and fixed to the board K. In the central portion of the placing portion 92, the through-hole 9*a* described before is provided. The insertion engaging piece 10, which includes the tongue piece 9*b* extending from one edge portion of the placing portion 92, extends to the lower side of the placing portion 92 through the through-hole 9*a*.

As shown in FIG. 17, on the board K on which the housing 1 is mounted, fixing holes K3, into which the insertion engaging piece 10 is inserted and fixed, are provided. An inner diameter of the fixing hole K3 is somewhat larger than an outer diameter of the insertion engaging piece 10 and the fixing hole K3 penetrates between both primary faces of the board K. On the primary face of the board K in the periphery of the fixing hole K3, attaching portion K11 covered with copper foil is provided. An inner circumferential face of fixing hole K3 is also covered with copper foil.

Figure 19A:
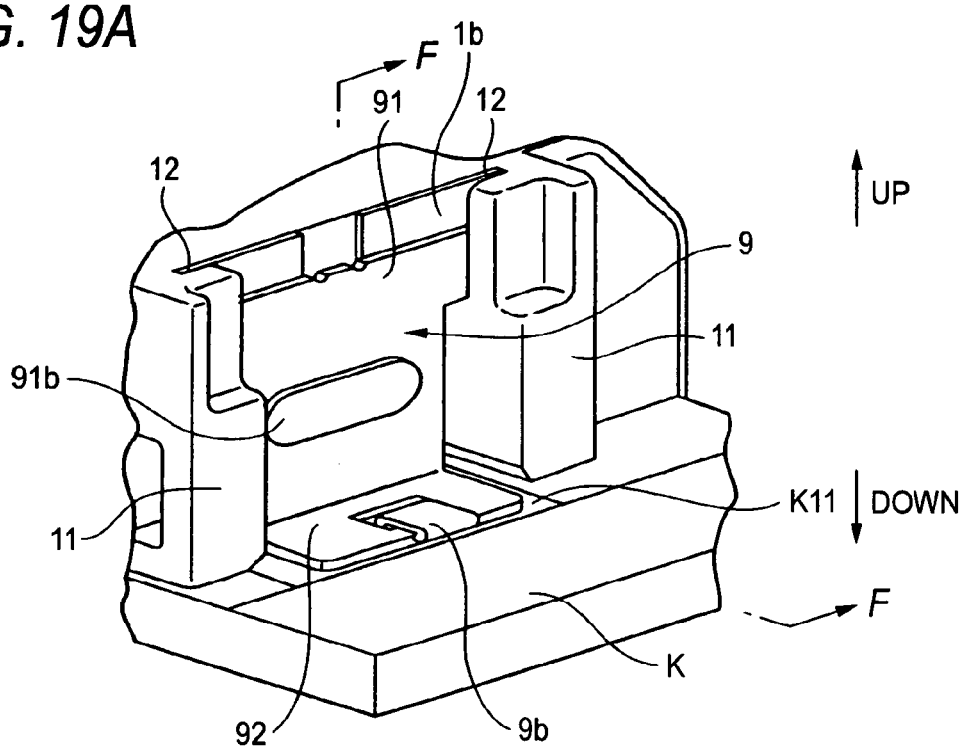
FIG. 19A is a perspective view showing the housing attached to the board by using the fixing bracket of the third embodiment.
Figure 19B:
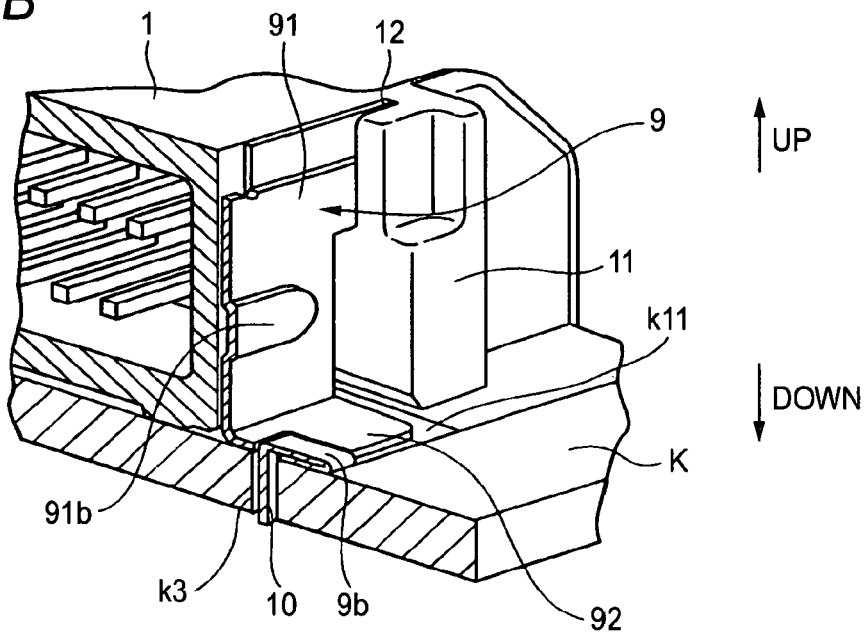
FIG. 19B is a cross-sectional view taken on line F-F in FIG. 19A.
Figure 20:
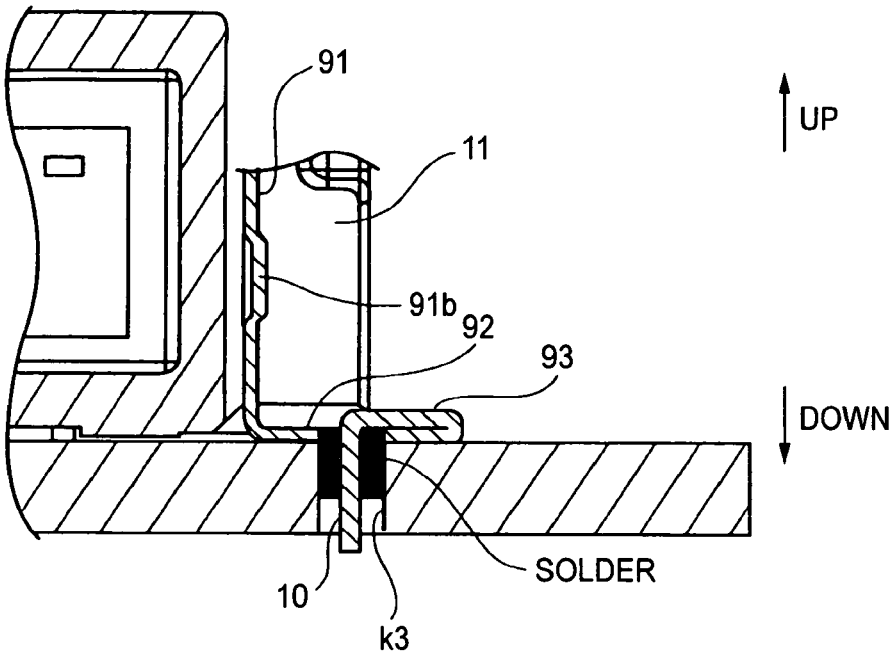
FIG. 20 is a view for explaining a positional relation between an insertion engaging piece and a fixing hole of the board.

Next, explanations will be made into a working process in which the connector housing 1 is attached to the board K by using the fixing bracket 8 composed as described above. FIG. 19A is a perspective view showing the housing 1 attached to the board K by using the fixing bracket 8 and FIG. 19B is a cross-sectional view taken on line F-F in FIG. 19A. FIG. 20 is a view for explaining a positional relation between an insertion engaging piece and a fixing hole of the board First of all, the attaching piece 9 of the fixing bracket 8 is inserted into the supporting portion 11 of the housing 1 from the upper side and engaged and temporarily fixed. Specifically, the attaching piece 9 is advanced into between both supporting portions 11 of the outer wall faces 1*b* of the housing 1 from the lower end side on which the placing portion 92 is provided.

A lower end of the engaging piece 91*a*, which is moved to a position close to the upper face of the housing 1, is inserted into an upper end opening portion of the engaging groove 12 of the supporting portion 11. When the attaching piece 9 continues to proceed between both supporting portions 11, a lower end portion of the engaging piece 91*a* of the engaging portion 91 comes into contact with a lower end portion of the engaging groove 12. Due to the foregoing, the attaching piece 9 is restricted from moving downward. At the same time, the attaching piece 9 is positioned with respect to the housing 1.

In this way, the attaching piece 9 of the fixing bracket 8 is engaged and temporarily fixed onto the right and left outer walls 1*b* of the housing 1. Successively, as shown in FIGS. 19A and 19B, the housing 1, to which the attaching piece 9 is temporarily attached, is placed on the attaching portion K11 of the board K together with the placing portion 92 of the attaching piece 9. At this time, as shown in FIG. 19B, positioning is executed so that the insertion engaging piece 10 which is integrally formed with the placing portion 92 of the attaching piece 9 can be placed at a position above the fixing-hole K3 of the board K.

After it is confirmed that the insertion engaging piece 10 is inserted into the fixing hole K3 of the board K, the periphery of the placing portion 92, which is placed on the attaching portion K11 of the board K, is soldered to the attaching portion K11. Further, the insertion engaging piece 10, which is inserted into fixing hole K3, is soldered to the fixing hole K3 of the board K. When the solder used for soldering is cooled and solidified, the placing portion 92 and the insertion engaging piece 10 are fixed onto the board K. The solder for fixing the insertion engaging piece 10 onto the board K composes a fixing means. The insertion engaging piece 10, which has been fixed onto the board K as described above, is composed integrally with the placing portion 92. Therefore, the placing portion 92 is restricted from moving upward.

The present invention has been specifically explained above referring to the first through the third embodiments. According to the fixing bracket 2, 5, 8 of each embodiment described above, by the engaging peg 4, 7 or the insertion engaging piece 10 which are inserted and fixed to the fixing hole K1, K2, K3 of the board K, the placing portion 32, 62, 92 is engaged from the upper side. Therefore, compared with a case in which the peripheral portion of the placing portion 32, 62, 92 is merely connected to the board K by means of soldering, in the case where a force is given so that the placing portion 32, 62, 92 can be separated from the board K, the placing portion 32, 62, 92 can be prevented from being disconnected from the board K. As a result, according to the fixing bracket 2, 5, 8, in the case where a force to separate the placing portion 32, 62, 92 from the board K is given in the direction perpendicular to the primary face of the board K, the connector housing 1 can be prevented together with the placing portion 32, 62, 92 from being disconnected from the board K. In accordance with the above configuration, the present invention can provide the above fixing bracket 2, 5, 8.

According to the fixing bracket 2, 5 of each embodiment described above, at the time of inserting the fixing bracket into the fixing hole K1, K2 of the board K, the engaging peg 4, 7 is soldered at the engaging position where the placing portion 32, 62 is engaged from the upper side. Therefore, when the placing portion 32, 62 and the engaging peg 4, 7 are soldered, the solder used for soldering the engaging peg 4, 7 is melted and the engaging peg 4, 7 can be inserted into the fixing hole K1, K2 of the board K. The solder used for soldering the engaging peg 4, 7 can be used for fixing the engaging peg 4, 7, which is inserted into the fixing hole K1, K2, as it is. When the placing portion 32, 62 is positioned so that the engaging peg 4, 7 can be located above the fixing hole K1, K2 of the board K, the placing portion 32, 62 can be positioned with respect to the board K. The fixing hole K1, K2 and the engaging peg 4, 7 can be used as a mark for positioning. As a result, it becomes possible to simplify the mounting work of mounting the connector on the board K.

According to the fixing bracket 5 of the second embodiment described above, a plurality of leg portions 72 of the engaging peg 7 are fixed into the fixing holes K2 formed on the board K. Therefore, the engaging piece 31*a* can be strongly fixed onto the board K. Further, not only both leg portions 72 of the engaging peg 7 but also the periphery of the hole portion 62*b*, which is formed in the placing portion 62 so as to provide the tongue piece 62*a*, can be soldered to the attaching portion K11 of the board K. Accordingly, the engaging piece 31*a* can be more strongly fixed to the board K.

According to the fixing bracket 5 of the second embodiment described before, when both leg portions 72 of the engaging peg 7 are inserted into the fixing holes K2, the central portion 71 of the engaging peg 7, which is located above the tongue piece 62*a*, is moved to an upper face of the tongue piece 62*a* and accommodated in the tongue piece 62*a*. Therefore, the tongue piece 62*a* can be used as a guide for guiding the engaging peg 7.

According to the fixing bracket 8 of the third embodiment, the placing portion 92 is positioned at a position in which the insertion engaging piece 10 is inserted into the fixing hole K3 of the board K. Therefore, the placing portion 92 can be positioned with respect to the board K. Further, the fixing hole K3 of the board K and the insertion engaging piece 10 can be used as a mark for positioning. As a result, it becomes possible to simplify the mounting work of mounting the connector on the board K.

According to the fixing bracket 8 of the third embodiment, the periphery of the through-hole 9*a*, which is provided for protruding the insertion engaging piece 10 downward from the placing face of the placing portion 92, can be connected onto the board K by using means such as a soldering. Therefore, the attaching piece 9 can be more strongly fixed onto the board K. The insertion engaging piece 10 is protruded to the lower side of the placing portion 92 through the through-hole 9*a* provided in the placing portion 92. Therefore, since a load is given to the front side portion 92*a* of the placing portion 92 when a force in the direction of arrow J acts on the engaging portion 91 and since a load is given to the rear side portion 92*b* of the placing portion 92 when a force in the direction of arrow K acts on the engaging portion 91, a load given to the insertion engaging piece 10 can be reduced. Therefore, it is possible to disperse the load to the periphery of the through-hole 9*a* from which the insertion engaging piece 10 is protruded. In this connection, in order to obtain the action effect described above, it is necessary to sufficiently disperse the load to the periphery of the through-hole 9*a*. Therefore, it is preferable that the through-hole 9*a* is located in the central portion in the longitudinal direction of the placing portion 92.

In the above explanation of each embodiment, the engaging peg 4, 7 or the insertion engaging piece 10 is inserted into an inserted portion which is the fixing hole K1, K2, K3 penetrating between both primary faces of the board K. However, as long as the engaging peg 4, 7 or the insertion engaging piece 10 can be inserted and fixed to it, the structure of the inserted portion may be arbitrarily determined. For example, the inserted portion may be formed out of a hole of the board K, and the depth of the hole from the primary face of the board K may be predetermined.

Any type fixing means may be arbitrarily employed. For example, it is possible to use a suitable fixing means for executing the present invention such as a bond or a fixing jig. Even in the case where the placing portion 32, 62, 92 is fixed onto the board K by using the means described above, the engaging peg 4, 7 or the insertion engaging piece 10, which are inserted and fixed into the fixing hole K1, K2, K3 on the board K, is engaged with the placing portion 32, 62, 92 from the upper side. Therefore, the placing portion 32, 62, 92 can be strongly fixed onto the board K and it becomes possible to prevent the housing 1 from being easily disconnected from the board K.

In the above explanation of the first and the second embodiments, when the placing portion 32, 62 of the attaching piece 36, which is engaged and temporarily fixed to the housing 1, is placed on the primary face of the board K, the engaging peg 4, 7 is attached to the placing portion 32, 62 so that the leg portion 42, 72 of the engaging peg 4, 7 can be positioned above the fixing hole K1, K2 of the board K. However, it is possible to employ such a structure that the leg portion 42, 72 of the engaging peg 4, 7 is inserted into the fixing hole K1, K2 of the board K when the placing portion 32, 62 of the attaching piece 3, 6, which is engaged and temporarily fixed to the housing 1, is placed on the primary face of the board K. According to this structure, not only the fixing hole K1, K2 of the board K and the engaging peg 4, 7 are used as marks for positioning but also the housing 1 can be accurately positioned with respect to the board K when the leg portion 42, 72 of the engaging peg 4, 7 is inserted into the fixing hole K1, K2. As a result, the mounting work of mounting the connector on the board K can be simplified.

In the first and the second embodiments explained above, one engaging peg 4, 7 is engaged with an upper face of the placing portion 32, 62 so as to fix the placing portion 32, 62 onto the board K. However, it should be noted that the number of the engaging pegs 4, 7 to be used may be arbitrarily determined.

In the third embodiment explained above, one insertion engaging piece 10 is arranged in the placing portion 92. However, the number of the insertion engaging pieces 10 provided in the placing portion 92 may be arbitrarily determined. In this case, the insertion engaging piece 10 may be formed out of a plurality of tongue pieces 9*b* provided in the edge portion of the placing portion 92. Alternatively, the insertion engaging piece 10 may be formed out of a plurality of protruding pieces provided on the forward end side of one tongue piece 9*b*.

In the second embodiment explained above, a pair of leg portions 72 are provided in both end portions of the engaging peg 7. However, the number of leg portions 72 may be arbitrarily determined. For example, one more leg portion 72 may be arranged between both leg portions 72. Further, the leg portions 72 are not necessarily arranged at both end portions of the engaging peg 7. The leg portions 72 may be arranged close to the central portion 71 between both end portions.

As long as the protrusion provided in the fixing bracket 8 is bent and inserted into the fixing hole K3, which is provided on the board K, from the surface to the back so that the fixing bracket 8 can be fixed onto the board K, an arbitrary structure of the insertion engaging piece 10 may be employed. For example, in the third embodiment explained above, the insertion engaging piece 10 is formed out of a tongue piece 9*b* extending downward from the lower end edge portion of the placing portion 92. However, the insertion engaging piece 10 may be formed in such a manner that a tongue piece, which is made by cutting the placing portion 92, is bent downward.

In each embodiment explained above, when the engaging piece 31*a*, 61*a*, 91*a* of the engaging portion 31, 61, 91 is inserted into the engaging groove 12 provided in the supporting portion 11 of the housing 1, the attaching piece 3, 6, 9 is attached and temporarily fixed to the housing 1. However, the attaching piece 3, 6, 9 may be attached to the housing 1 by an arbitrary method using means such as screwing and adhesive. Further, an arbitrary structure of the engaging member may be adopted as long as it can be inserted and fixed into the fixing hole K1, K2, K3 of the board K and engaged from the upper side of the placing portion 32, 62, 92.

As long as the fixing bracket 2, 5, 8 attached to the supporting portion 11 of the housing 1 is fixed onto the board K and the housing 1 is attached onto the board K, the attaching order may be arbitrarily determined. For example, the fixing bracket 2, 5, 8 may be attached to the housing 1 placed on the board K. In the embodiments explained above, the supporting portion 11 is composed integrally with the housing 1. However, the housing 1 and the supporting portion 11 may be composed differently from each other. In the embodiments explained above, the present invention is applied to the fixing bracket 2, 5, 8 in which the connector housing 1 is attached to the board K. However, it is possible to apply the present invention to a fixing bracket used for fixing a housing except for the connector housing.

What is claimed is:

1. A fixing bracket for fixing a housing on a board, comprising:

a placing portion which is configured to be placed on the board;

an attaching portion which is continuous from one end of the placing portion substantially at right angle and which is configured to be attached to the housing;

engaging portions which are respectively extended from both sides of the attaching portion so as to expand in part a width of the attaching portion;

a through hole which is formed through the placing portion; and a tongue piece which is extended from the other end of the placing portion, wherein a root portion of the tongue piece is folded substantially at 180 degrees and an intermediate portion of the tongue piece is folded substantially at right angle so that a part of the tongue piece between the root portion and the intermediate portion is superimposed on a surface of the placing portion and a part of the tongue piece from the intermediate portion to an apex portion of the tongue piece is inserted through the through hole to the board, wherein the tongue piece and the placing portion are originally formed of a single plate and remain unitary, and the attaching portion has a first width at a location where the engaging portions are disposed and a second width at a location other than where the engaging portions are disposed, the first width being greater than the second width.

2. The fixing bracket according to claim 1, wherein the tongue piece is directly extended from the other end of the placing portion.

3. The fixing bracket according to claim 1, wherein the tongue piece is integral with the placing portion.

4. A fixing structure, comprising:

a board;

a housing; and a fixing bracket including:

a placing portion placed on the board;

an attaching portion which is continuous from one end of the placing portion substantially at right angle and which is attached to the housing;

engaging portions which are respectively extended from both sides of the attaching portion so as to expand in part a width of the attaching portion and engage with the housing;

a through hole which is formed through the placing portion; and a tongue piece which is extended from the other end of the placing portion, wherein a root portion of the tongue piece is folded substantially at 180 degrees and an intermediate portion of the tongue piece is folded substantially at right angle so that a part of the tongue piece between the root portion and the intermediate portion is superimposed on a surface of the placing portion and a part of the tongue piece from the intermediate portion to an apex portion of the tongue piece is inserted through the through hole to the board, wherein the tongue piece and the placing portion are originally formed of a single plate and remain unitary, and the tongue piece is inserted into a through hole of the board so as to retain the placing portion on the board.

5. The fixing structure according to claim 4, wherein the tongue piece is fixed to the through hole of the board with a fixing member.

6. The fixing structure according to claim 4, wherein the tongue piece is soldered to the through hole of the board.

7. The fixing structure according to claim 4, wherein the tongue piece is integral with the placing portion.

8. A method of fixing a housing to a board, comprising:

providing a fixing bracket which includes:

a placing portion;

an attaching portion which is continuous from one end of the placing portion substantially at right angle;

engaging portions which are respectively extended from both sides of the attaching portion so as to expand in part a width of the attaching portion;

a through hole which is formed through the placing portion; and a tongue piece which is extended from the other end of the placing portion, wherein the tongue piece and the placing portion are originally formed of a single plate and remain unitary;

folding a root portion of the tongue piece substantially at 180 degrees and an intermediate portion of the tongue piece substantially at right angle so that a part of the tongue piece between the root portion and the intermediate portion is superimposed on a surface of the placing portion and a part of the tongue piece from the intermediate portion to an apex portion of the tongue piece is inserted into the through hole of the fixing bracket from an observe side toward a back side of the placing portion; and inserting the tongue piece into a through hole of the board so as to retain the placing portion on the board.

9. The method according to claim 8, wherein the tongue piece is fixed to the through hole of the board with a fixing member.

10. The method according to claim 8, wherein the tongue piece is soldered to the through hole of the board.

11. The method according to claim 8, wherein the tongue piece is integral with the placing portion.

* * * * *